United States Patent [19]

Augustine, Jr.

[11] Patent Number: 4,493,266

[45] Date of Patent: Jan. 15, 1985

[54] RAILWAY HOPPER CAR AND CENTER SILL CONSTRUCTION THEREFOR

[75] Inventor: Paul C. Augustine, Jr., Butler, Pa.

[73] Assignee: General American Transportation Corporation, Chicago, Ill.

[21] Appl. No.: 383,819

[22] Filed: Jun. 1, 1982

[51] Int. Cl.[3] ..... B61D 7/08; B61D 17/00; B61F 1/00

[52] U.S. Cl. ..... 105/255; 105/245; 105/251; 105/258; 105/416; 105/418; 105/420; 105/421

[58] Field of Search ..... 105/240, 247, 248, 250, 105/251, 413, 414, 415, 416, 417, 418, 419, 420, 421, 245, 255, 258

[56] References Cited

U.S. PATENT DOCUMENTS

| | | | |
|---|---|---|---|
| 1.028,882 | 6/1912 | Ingoldsby | 105/245 |
| 1,075,571 | 10/1913 | Irwin et al. | 105/248 |
| 1,522,624 | 1/1925 | Hart | 105/251 |
| 1,804,769 | 5/1931 | Hart et al. | 105/415 X |
| 1,881,797 | 10/1932 | Martin | 105/416 X |
| 1,950,001 | 3/1934 | Gilpin et al. | 105/415 X |
| 2,084,859 | 6/1937 | Meyer et al. | 105/415 |
| 2,092,457 | 9/1937 | Kiesel, Jr. | 105/415 X |
| 2,167,362 | 7/1939 | Hindahl | 105/251 |
| 3,427,994 | 2/1969 | Keene | 105/248 |
| 3,515,076 | 6/1970 | Aquino | 105/251 |
| 3,635,515 | 6/1972 | Shaver et al. | 105/240 |
| 3,868,913 | 3/1975 | Becker et al. | 105/240 |
| 3,921,537 | 11/1975 | Fleshman et al. | 105/248 |
| 4,003,319 | 1/1977 | Campbell et al. | 105/248 |
| 4,138,948 | 2/1979 | Korolis | 105/251 |

*Primary Examiner*—Randolph Reese
*Assistant Examiner*—Howard Beltran
*Attorney, Agent, or Firm*—Emrich & Dithmar

[57] ABSTRACT

A railway hopper car has a through center sill including an elongated central section substantially A-shaped in transverse cross section, two end sections substantially hat-shaped in transverse cross section and two transition sections respectively connecting said end sections to the adjacent ends of the central section. The central section has upper and lower parts, each of which may comprise a plurality of subsections arranged in end-to-end relationship. Each transition section includes a transition member rectangular at one end for mating with the end section and trapezoidal at the other end for mating with the lower part of the central section. Each transition section also includes an inverted V-shaped top reinforcing member and a horizontal bottom reinforcing plate. Alternative forms of the lower part of the central section are disclosed.

30 Claims, 8 Drawing Figures

RAILWAY HOPPER CAR AND CENTER SILL CONSTRUCTION THEREFOR

BACKGROUND OF THE INVENTION

The present invention relates to railway hopper cars and, in particular, to an improved center sill construction therefor.

In a conventional railway freight car construction a center sill extends from one end of the car to the other and is located approximately in alignment with the coupling line. It serves primarily to transmit the longitudinal draft loads through the car and to aid in supporting the vertical loads between major cross members. The center sill is usually hat-shaped in transverse cross section and may be fabricated by welding two Z-sections together. In hopper cars it is necessary to install inverted V-shaped hoods on top of the hat-shaped center sill to allow lading to pass around the sill and out the bottom opening to unload the car and to prevent lading from accumulating on top of the center sill. This conventional type of hopper car construction is disclosed, for example, in U.S. Pat. No. 3,868,913.

In order to avoid the use of such a hood, hopper cars have been provided with tubular center sills which pass through the hoppers, the center sill being shaped and positioned so that lading will pass around it, thereby obviating a separate hood. Such a tubular center sill is disclosed, for example, in U.S. Pat. No. 4,003,319.

However, such tubular center sills have certain disadvantages. First of all, the conventional arrangement of a hat-shaped center sill cooperates with the associated hood to provide a convenient passage and support for the brake rod of the railway car. This passage and support is lost in the tubular center sill construction, which does not utilize an associated hood. Furthermore, both the tubular center sill and the more conventional hat-shaped center sill require the use of separate parts that extend out and below both sides of the center sill to form a lip for the hopper doors to seal against.

SUMMARY OF THE INVENTION

It is a general object of this invention to provide an improved railway hopper car and center sill construction therefor which avoid the disadvantages of prior constructions while affording additional structural and operating advantages.

An important object of this invention is the provision of a center sill construction for a railway hopper car which avoids the use of a separate hood at locations where the sill passes through the hoppers, while at the same time providing a passage and support for the brake rod of the car.

It is another object of this invention to provide a center sill construction of the type set forth which affords lips for the hopper doors to seal against, thereby obviating the use of separate structure for this purpose.

Still another object of this invention is the provision of a center sill construction of the type set forth which has improved strength and rigidity, being capable of transmitting coupler loads without buckling or deformation.

In connection with the foregoing objects, it is another object of this invention to provide a railway hopper car which includes a center sill construction of the type set forth.

These and other objects of the invention are attained by providing a through center sill construction for a railway hopper car having draft and coupling mechanisms at each end thereof, the center sill construction comprising an elongated central section extending longitudinally of the associated car substantially from one of the draft and coupling mechanisms to the other and being substantially A-shaped in transverse cross section and two end sections respectively coupled to the central section at the opposite ends thereof for respectively housing the associated draft and coupling mechanisms.

The invention consists of these and other novel features and a combination of parts hereinafter fully described, illustrated in the accompanying drawings, and particularly pointed out in the appended claims, it being understood that various changes in the details may be made without departing from the spirit or sacrificing any of the advantages of the invention.

DESCRIPTION OF THE PREFERRED EMBODIMENTS

Figure 1:
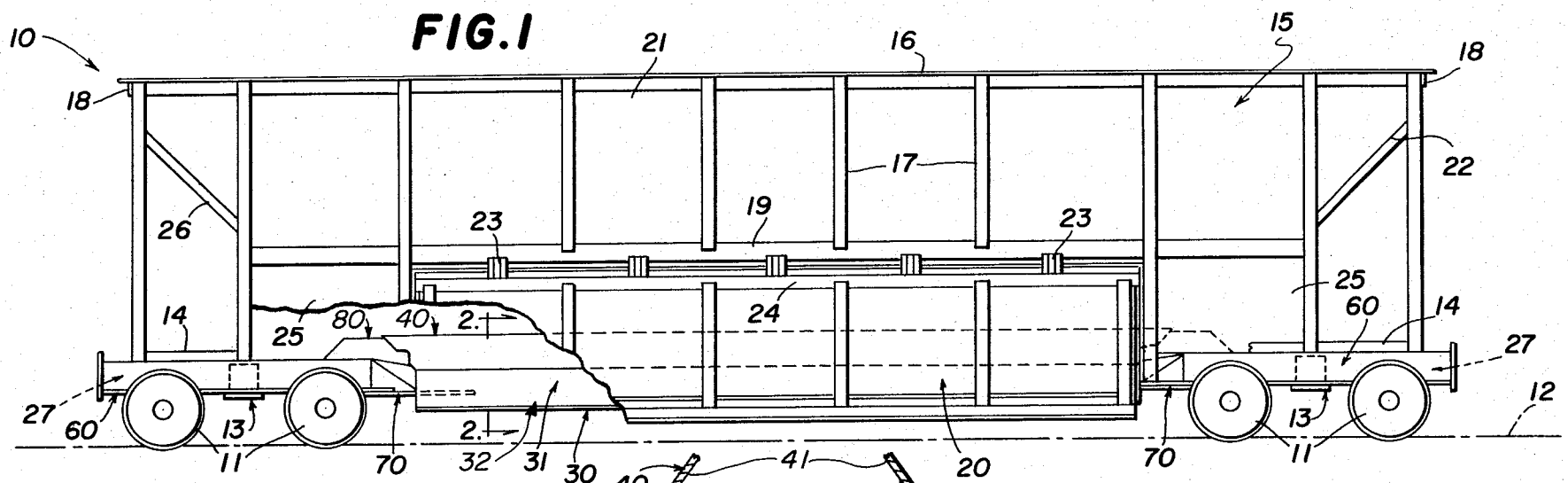
FIG. 1 is a side elevational view of a railway hopper car incorporating a center sill construction embodying the features of the present invention, a portion of the car being broken away more clearly to illustrate the center sill construction.
Figure 5:
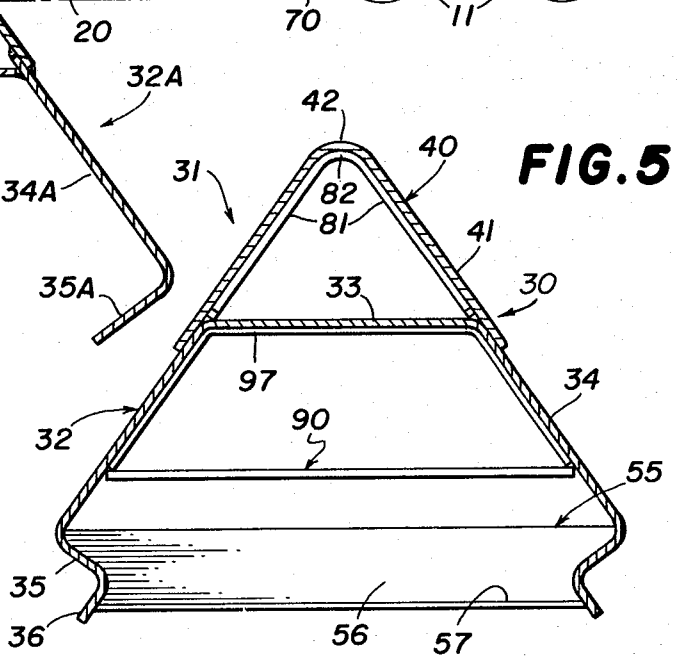
FIG. 5 is a further enlarged view in vertical section taken along the line 5—5 in FIG. 4.

Referring to FIG. 1 of the drawings, there is illustrated a railway hopper car, generally designated by the numeral 10, which has conventional truck assemblies each containing pairs of wheels 11 that ride upon a pair of rails, one of which is shown in phantom line and designated by the numeral 12. Both ends of the car 10 have a bolster structure, generally indicated at 13, that is mounted on the truck assemblies at the ends of the car 10. Mounted on the bolster structures 13 is a horizontal through center sill, generally designated by the numeral 30, which will be described in greater detail below. For each side of the car 10 at its ends there are provided horizontal stub side sills 14 that are also mounted on the bolster structures 13. Of course, each bolster structure 13 includes, as is conventional a truck bolster and a body bolster.

The car 10 has a body 15 which is mounted on supporting structure that includes the stub side sills 14 and the center sill 30. Each side of the car body 15 includes a horizontal top chord or side plate 16 and a number of vertical side stakes 17 spaced from one another in the direction of the longitudinal axis of the car 10. The ends of the two top chords 16 are interconnected by two horizontal end chords 18.

The car body 15 also has, for each side, a horizontal intermediate side sill 19. Each side of the car 10 has a hopper door assembly, generally designated by the numeral 20, that extends lengthwise of the car 10 and has its upper portion forming a part of that side of the car 10. The remainder of each side of the car body 15 is formed by a side panel 21 having truncated sloping ends which are interconnected by sloping end wall panels 22. Each hopper door assembly 20 is pivotally mounted on the associated one of the intermediate side sills 19 by a number of hinge assemblies 23, each of which includes a number of hinge lugs mounted on the intermediate side sill 19 and others mounted on an upper chord 24 of the associated door assembly 20, these two sets of hinge lugs being interconnected by a suitable hinge pin (not shown).

For each side of the car 10 there is located adjacent each end a shear-resistant lower side panel 25 connected beneath the intermediate side sill 19 and alongside the adjacent end of the hopper door assembly 20. End reinforcements 26 are provided along the sloping end wall panels 22. Draft and coupling mechanisms (not shown), the positions of which are generally indicated at 27, are provided within the ends of the center sill 30 in a conventional manner.

Referring now also to FIGS. 2 through 5 of the drawings, the center sill 30 includes an elongated central section 31, two end sections 60 and two transition sections 70 respectively connecting the end sections 60 to the adjacent ends of the central section 31. The center sill 30 is symmetrical about the transverse center plane of the car 10 and, therefore, only portions of the left-hand end of the center sill 30, as viewed in FIG. 1, have been illustrated in detail in the drawings.

The central section 31 of the center sill 30 is generally A-shaped in transverse cross section, and includes a plurality of lower sill members 32 arranged in end-to-end relationship and a plurality of cap sill members including two end cap sill members 40 and one or more central cap sill members 46 (FIGS. 3 and 4), all arranged in end-to-end relationship and overlying the lower sill members 32. The number of aligned lower sill members 32 and cap sill members 40 and 46 utilized will depend on the length of these members and the length of the car 10.

Each of the lower sill members 32 is an elongated member which has a transverse cross section generally in the shape of an open-bottom trapezoid. More particularly, the lower sill member 32 has a flat, horizontal top wall 33 integral at the lateral edges thereof, respectively, with two downwardly and outwardly sloping side walls 34. Each of the side walls 34 is provided along the lower edge thereof with an inturned flange 35 extending therefrom substantially normal thereto, each of the flanges 35 in turn being provided along its distal edge with a short outturned flange 36 extending generally parallel to the associated side wall 34. Adjacent ones of the lower sill members 32 have the end edges thereof abutting and joined together by welding with the aid of back up bars 37 and backup bars 38 (see FIGS. 3 and 4) spanning the junction of the lower sill members 32 along the inner surfaces thereof. The backup bars 38 project a predetermined slight distance outwardly beyond the lower edges of the outturned flanges 36.

Figure 3:
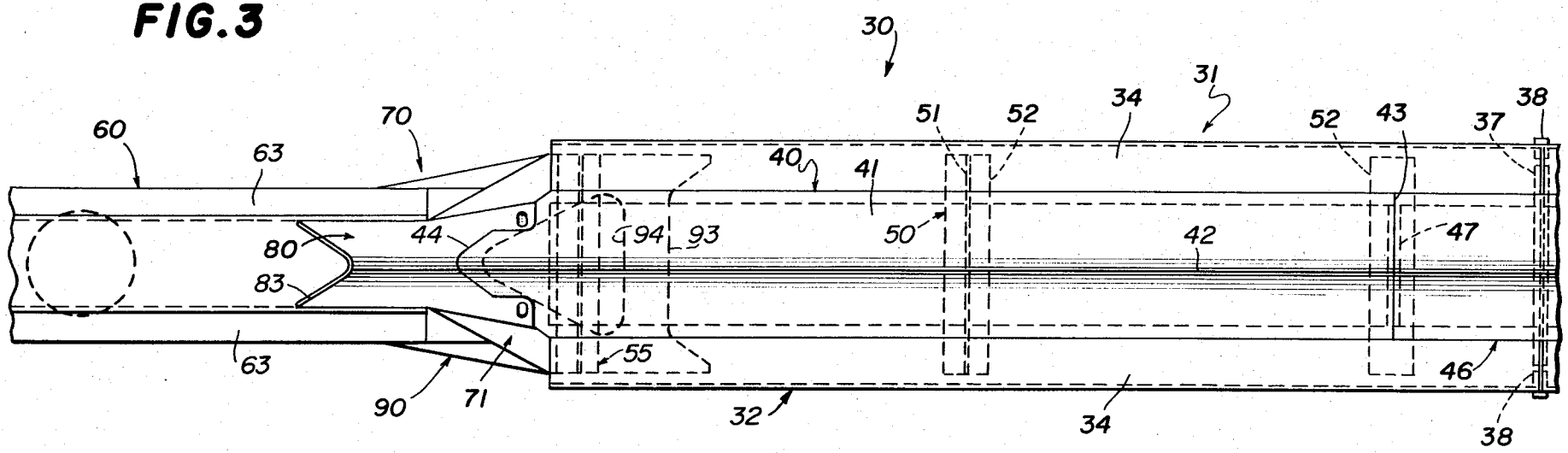
FIG. 3 is an enlarged fragmentary top plan view of a portion of the center sill construction of the hopper car of FIG. 1.
Figure 4:
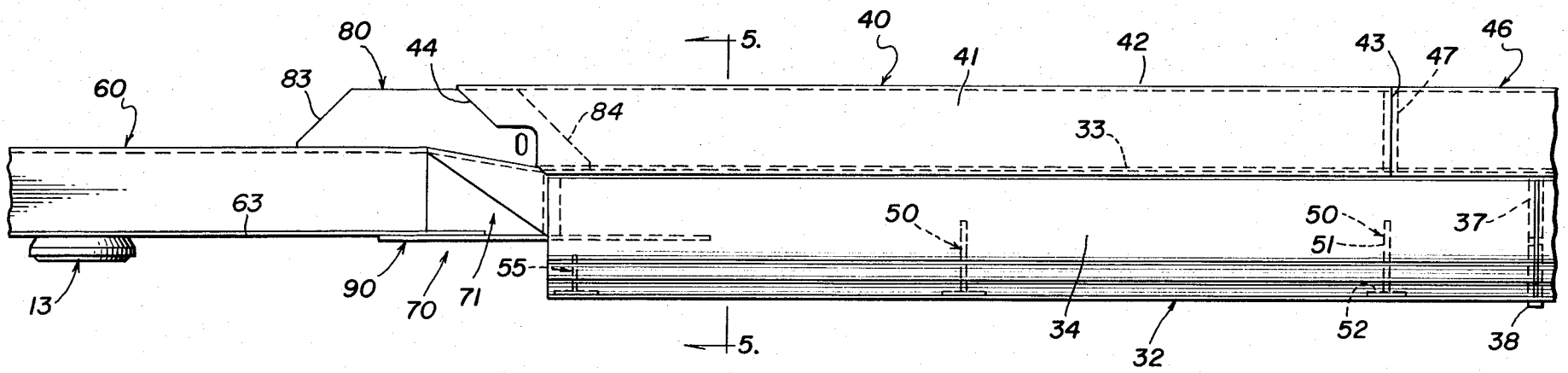
FIG. 4 is a side elevational view of the center sill construction illustrated in FIG. 3.

The end cap sill members 40 are constructed as mirror images of each other, only the left-hand one being illustrated in detail in FIGS. 3 and 4. The end cap sill member 40 is an elongated member having an inverted V-shape in transverse cross section. More particularly, each end cap sill member 40 includes a pair of upwardly converging sloping sides 41 joined by an arcuate apex 42. The inner end of the cap sill member 40 has an end edge 43 which lies in a vertical plane, while the outer end thereof has downwardly and inwardly tapered end edges 44, provided intermediate the upper and lower ends thereof with a recessed portion 45 (see FIGS. 6 and 7) for a purpose to be explained more fully below.

The end cap sill members 40 are arranged so that the sloping sides 41 thereof are respectively parallel to the sloping side walls 34 of the lower sill members 32, with the lower ends of the sloping sides 41 overlapping the upper ends of the sloping side walls 34 and fixedly secured thereto as by welding. The central cap sill members 46 (FIGS. 3 and 4) are substantially identical to the end cap sill members 40, with the exception that both ends of the central cap sill members 46 have the edges thereof lying in vertical planes so as to abut the adjacent inner end edges 43 of the end cap sill members 40. The abutting ends of the cap sill members 40 and 46 are joined together as by welding with the aid of back up bars 47 spanning the junction therebetween along the inner surfaces thereof (see FIGS. 3 and 4).

The apex of the A-shaped center sill 30 projects upwardly into the hoppers of the car 10, and it will be appreciated that the shape of the center sill 30 is such that it sheds lading within the hoppers, thereby obviating the use of a separate hood over the center sill 30. Furthermore, it is an important feature of the present invention that the top walls 33 of the lower sill members 32, which form the cross bar of the A shape, cooperate with the cap sill members 40 and 46 to define therebetween a passage for a brake rod (not shown) of the car 10, the top walls 33 also affording support for the brake rod. Another aspect of the invention is that the outturned flanges 36 of the lower sill members 32 provide lips against which the hopper door assemblies 20 may seal along the opposite sides of the car 10, thereby obviating the provision of separate structure for this purpose.

It has also been found that the A-shaped center sill 30 provides unique structural strength and rigidity. Thus, the top walls 33 of the lower sill members 32 serve to divide the sloping sides of the A into approximately equal upper and lower panels and ties them together, thereby enabling these panels to carry the compressive draft loads of the car 10 without buckling as a plate. Furthermore, the flanges 35 and 36 at the bottom of the lower sill members 32 serve to stiffen this area so it can carry the compressive coupler loads without buckling as a column. The enclosed triangular area formed by the top walls 33 and the cap sill members 40 and 46 acts as a torque tube for providing torsional rigidity to the car structure.

Figure 7:
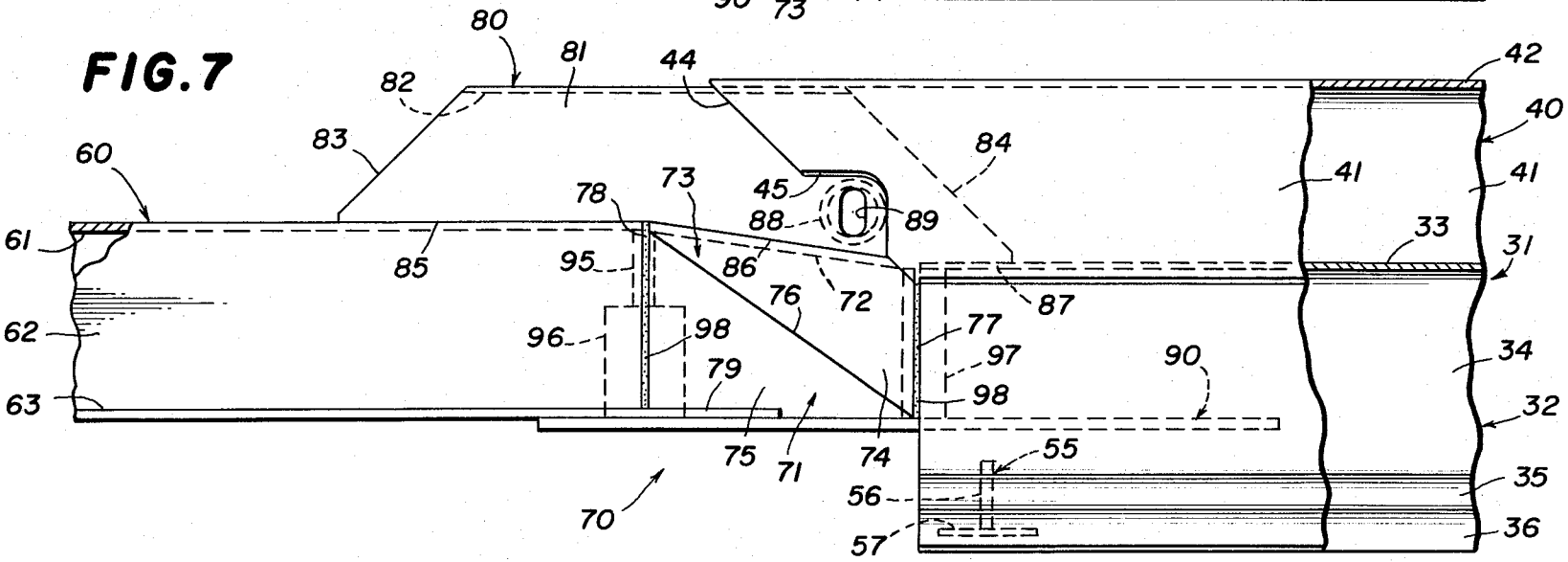
FIG. 7 is a fragmentary side elevational view of the transition section of FIG. 6.

The lower sill members 32 of the center sill 30 are provided with gusset plates 50 (FIGS. 3 and 4) extending transversely thereacross at longitudinally spaced-apart locations thereon, each of the gusset plates 50 including a vertical plate 51 and a horizontal flange 52 for providing lateral rigidity. At the ends of the center sill 30, the lower sill members 32 are provided with smaller gusset plates 55, each including a vertical plate 56 and a horizontal plate 57 (FIG. 7).

Figure 8:
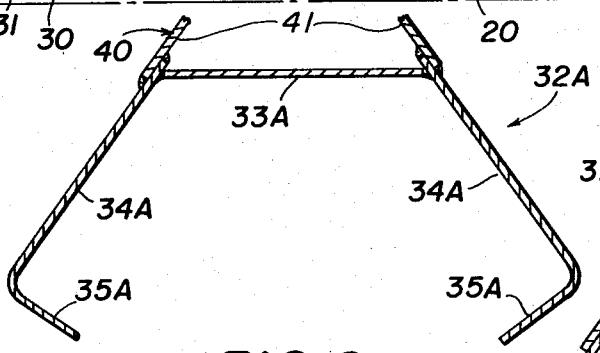
FIG. 8 is a fragmentary view, similar to FIG. 2, illustrating an alternative form of the lower part of the central section of the center sill construction illustrated in FIG. 2.
Figure 2:
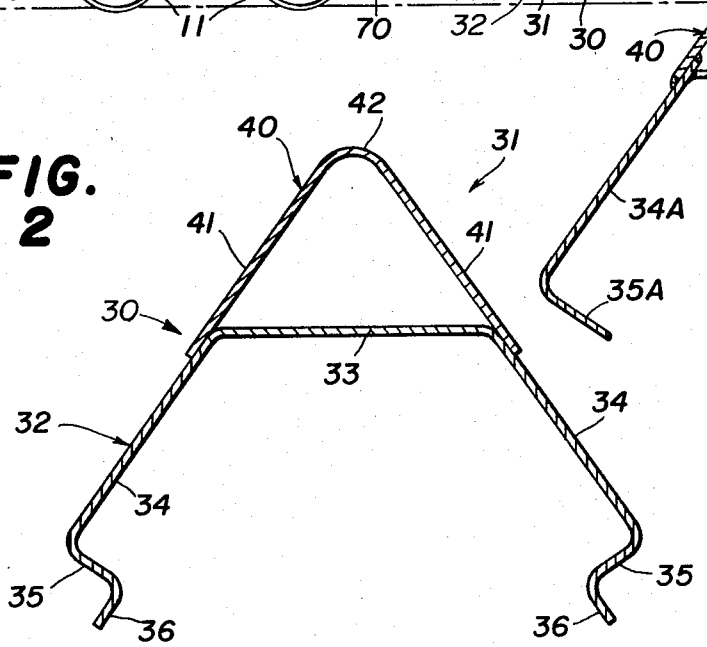
FIG. 2 is an enlarged view in vertical section, taken along the line 2—2 in FIG. 1, illustrating the central section of the center sill construction.

Referring now to FIG. 8 of the drawings, there is illustrated an alternative form of lower sill member, generally designated by the numeral 32A, which is of three-part construction. The lower sill member 32A has substantially the same shape as the lower sill member 32 but comprises a horizontal plate 33A and discrete sloping side plates 34A, all interconnected by welding. The lower sill member 32A cooperates with the cap sill members 40 and 46 in exactly the same manner as do the lower sill members 32 of FIG. 2. Each of the sloping side plates 34A is provided at the lower edge thereof with an inturned flange 35A, which may be slightly longer than the corresponding flanges 35 of the lower sill member 32. In this construction, the out-turned flanges 36 may be omitted. It will be appreciated that the one-piece lower sill member 32 could be provided with the flange 35A and the three-piece lower sill member 32A could be provided with the flanges 35 and 36.

The end sections 60 of the center sill 30 respectively overlie the truck assemblies and respectively enclose and support the associated draft and coupling mechanisms 27 in a conventional manner. Accordingly, each of the end sections 60 has the conventional hat-shaped transverse cross section, each end section 60 being an elongated structure having a flat horizontal top wall 61 and a pair of opposed vertical side walls 62 respectively provided at the lower edges thereof with laterally outwardly extending horizontal flanges 63 (FIGS. 6 and 7).

The transition sections 70 provide an interconnection between the central sections 31 and the differently-shaped end sections 60. Since the transition sections 70 are formed as mirror images of each other, only the left-hand one, as viewed in FIG. 1, has been illustrated in detail. Each of the transition sections 70 includes a transition member 71, a cap reinforcement member 80 and a bottom reinforcement plate 90. Preferably, each transition member 71 is formed as a metal casting and each of the cap reinforcement members 80 and bottom reinforcement plates 90 is formed of steel plate. Alternatively, the entire transition section 70 may be formed as a single large casting.

Figure 6:
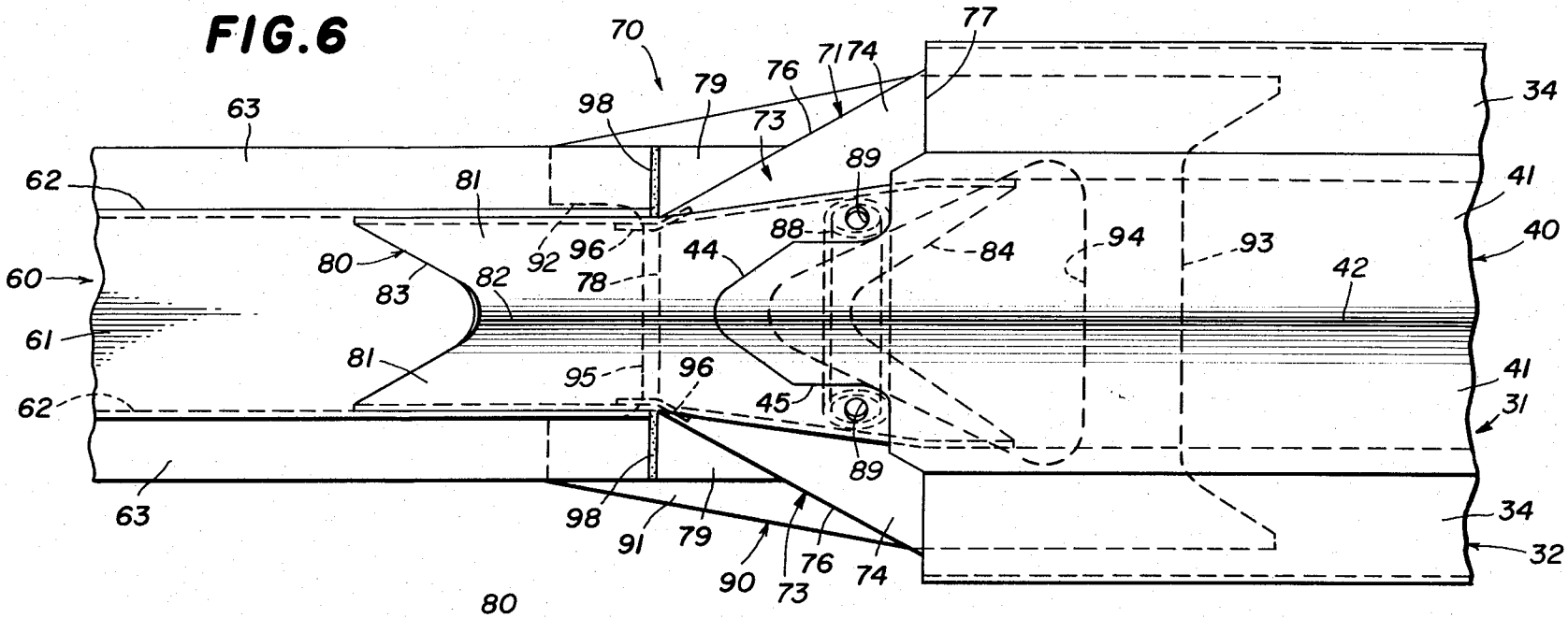
FIG. 6 is a further enlarged fragmentary top plan view of the transition section portion of the center sill construction of FIG. 3.

Referring now also to FIGS. 6 and 7 of the drawings, the transition member 71 includes a downwardly and inwardly sloping top wall 72 (see FIG. 7) which is substantially trapezoidal in shape, and which is integral along the lateral side edges thereof, respectively, with two depending side walls 73. Each of the side walls 73 comprises upper and lower flat planar triangular portions 74 and 75, inclined at an obtuse angle with respect to each other and intersecting along a bend line 76 which extends from the adjacent upper corner of the associated end section 60 at the inner end thereof, downwardly and longitudinally inwardly of the center sill 30 to a point laterally outwardly of and vertically coplanar with the inner edge of the top wall 72 and horizontally coplanar with the bottom of the end section 60. There results an arrangement wherein each side wall 73 flares laterally outwardly and downwardly from the outer end of the transition member 71 to the inner end thereof, and provides the transition member 71 with a substantially trapezoidal inner end 77 adapted for mating abutment with the adjacent end of the lower sill member 32 of the central section 31, and with a substantially rectangular outer end 78 for mating abutment with the inner end of the adjacent end section 60. Each of the side walls 73 is provided along the lower edge thereof with a laterally outwardly extending triangular flange 79 adapted for mating abutment with the adjacent edge of the associated side flange 63 of the adjacent end section 60.

Each of the cap reinforcement members 80 is similar in shape to the cap sill members 40 and 46, having an inverted V-shaped transverse cross section. More specifically, each cap reinforcement member includes a pair of upwardly converging sloping side walls 81 joined at an arcuate apex 82 and having sloping outer and inner ends 83 and 84. The bottom edge of each side wall 81 is adapted to follow the contour of the underlying structure, and includes a horizontal edge portion 85 engaging the top wall 61 of the end section 60 and a sloping edge portion 86 engaging the sloping top wall 72 of the transition member 71. Interconnecting the side walls 81 adjacent to the inner ends thereof is a tube 88, the ends of which are respectively disposed in registry with oval apertures 89 in the side walls 81, access to which is afforded by the recesses 45 in the sloping sides 41 of the end cap sill member 40.

The bottom reinforcement plate 90 is a flat horizontal plate which is generally rectangular in outline, but is provided with a tapered outer end 91 which underlies the transition member 71 and the adjacent end section 60. The tapered outer end 91 is provided with an enlarged recess 92 in the outer edge thereof dimensioned so that the portion of the bottom reinforcing plate 90 which underlies the end section 60 underlies only the side flanges 63 thereof and is open in the region between the side flanges 63. The inner end of the bottom reinforcing plate 90 extends well within the lower sill member 32 of the central section 31 and is fixedly secured, as by welding, to the sloping side walls 34 thereof. The plate 90 is provided with a recess 93 along the inner edge thereof and a large triangular aperture 94 therein. The recesses 92 and 93 serve to reduce stress concentration at the termination of the connections.

The cap reinforcement member 80 and the bottom reinforcement plate 90 are preferably fixedly secured to the adjacent portions of the end section 60, the reinforcing member 71 and the central section lower sill member 32, as by welding. Additionally, weldments 98 are preferably provided between each transition member 71 and the abutting end edges of the end sections 60 and the central section lower sill member 32. Also, a generally rectangular gusset plate 95 is provided between the side walls 62 of the end sections 60 spanning the junction thereof with the transition member 71 at the upper end thereof. Back up plates 96 are disposed beneath the gusset plate 95 and also span the junction between the end section 60 and the transition member 71 respectively along the opposite sides thereof on the inner surfaces thereof. A back up plate 97 spans the junction between the transition member 71 and the central section lower sill member 32 along the entire length thereof (see FIG. 7).

From the foregoing, it can be seen that there has been provided an improved center sill construction for a railway hopper car which has a geometric shape designed to channel the lading in the hoppers and frame the hopper door openings, while at the same time permitting the use of the conventional hat-shaped cross section at the ends to house the draft and coupling mechanisms. In addition, the parts have been proportioned and shaped so that they can transmit the longitudinal coupler loads through the car, support the vertical loads and contribute to the torsional rigidity of the car structure, while at the same time providing a passage for the brake rod of the car.

I claim:

1. A through center sill construction for a railway hopper car having draft and coupling mechanisms at each end thereof, said center sill construction comprising an elongated central section extending longitudinally of the associated car substantially from one of the draft and coupling mechanisms to the other and being substantially A-shaped in transverse cross section, said central section including an upper part having a transverse cross section substantially in the shape of an inverted V and a lower part having a transverse cross section generally in the shape of an open-bottom trapezoid, each of said upper and lower parts having a pair of upwardly converging inclined side walls, the side walls of said upper part being disposed in parallel integral relationship respectively with the side walls of said lower part, and two end sections respectively coupled to said central section at the opposite ends thereof for respectively housing the associated draft and coupling mechanisms.

2. The center sill construction of claim 1, wherein said lower part includes two sloping side parts and a horizontal part interconnecting said side parts at the upper ends thereof.

3. The center sill construction of claim 1, wherein said central section comprises a plurality of subsections arranged in end-to-end relationship.

4. The center sill construction of claim 1, wherein said central section includes a plurality of longitudinally spaced-apart transversely extending reinforcing members.

5. The center sill construction of claim 1, wherein each of said end sections has a different transverse cross section from that of said central section, and further including two transition sections respectively connecting the ends of said central section to the adjacent end sections.

6. The center sill construction of claim 1, wherein each of said side walls of said lower part includes a laterally inturned flange integral therewith at the lower end thereof.

7. The center sill construction of claim 6, wherein each of said inturned flanges is provided at the distal end thereof with a laterally outturned flange.

8. A through center sill construction for a railway hopper car having draft and coupling mechanisms at each end thereof, said center sill construction comprising: an elongated central section extending longitudinally of the associated car substantially from one of the draft and coupling mechanisms to the other, said central section being substantially A-shaped in transverse cross section and including sloping side walls converging upwardly to an apex and a horizontal wall interconnecting said side walls intermediate the upper and lower ends thereof and separating said central section into upper and lower portions; two end sections respectively coupled to the associated draft and coupling mechanisms for housing same; and two transition sections respectively coupled to the opposite ends of said central section, each of said transition sections including a transition member connected to the adjacent end section and to said lower portion of said central section, and two reinforcing members respectively overlying and underlying said transition member and connected thereto and to said central section and to the adjacent one of said end sections.

9. The center sill construction of claim 8, wherein said underlying reinforcing member comprises a flat plate disposed substantially horizontally and underlying said transition member and the adjacent one of said end sections and having one end thereof received within said lower portion of said central section and fixedly secured thereto.

10. The center sill construction of claim 8, wherein each of said end sections is generally hat-shaped in transverse cross section including a horizontal top wall and a pair of opposed depending side walls and two laterally outwardly extending horizontal flanges respectively integral with said side walls at the lower ends thereof.

11. The center sill construction of claim 10, wherein said transition member includes a top wall and a pair of opposed side walls, said transition member cooperating with said underlying reinforcing member to define at one end of said transition member a rectangular transverse cross section for mating engagement with the adjacent one of said end sections and to define at the other end of said transition member a trapezoidal transverse cross section for mating engagement with said lower portion of said central section.

12. The center sill construction of claim 11, wherein each of said transition member side walls includes generally triangular upper and lower portions inclined at an obtuse angle with respect to each other and intersecting along a line extending from the top of the adjacent one of said end sections to said underlying reinforcing member at the associated one of said central section side walls.

13. The center sill construction of claim 11, wherein the opposite ends of said transition member are respectively fixedly secured to said central section and the adjacent one of said end sections in end-to-end abutting relationship.

14. The center sill construction of claim 13, wherein said transition member includes a pair of flanges at the lower end thereof respectively disposed in end-to-end abutting relationship with said flanges of the adjacent one of said end sections and fixedly secured thereto.

15. The center sill construction of claim 8, wherein each of said overlying reinforcing members has an inverted V-shaped transverse cross section and overlies and is fixedly secured to said top wall of said transition member and to said top wall of the adjacent one of said end sections and to said horizontal wall of said central section.

16. The center sill construction of claim 15, wherein one end of each of said overlying reinforcing members is telescopically received within the adjacent end of said central section.

17. The center sill construction of claim 16, wherein each of said overlying reinforcing members includes a tubular reinforcing member extending transversely thereof.

18. A through center sill construction for a railway hopper car having draft and coupling mechanisms at each end thereof, said center sill construction comprising: an elongated central section extending longitudinally of the associated car substantially from one of the draft and coupling mechanisms to the other, said central section being substantially A-shaped in transverse cross section and including sloping side walls converging upwardly to an apex, and a horizontal wall interconnecting said side walls intermediate the upper and lower ends thereof and separating said central section into upper and lower portions, said apex of said central section extending upwardly into said hoppers and being positioned to shed associated lading; two end sections respectively coupled to the associated draft and coupling mechanisms for housing same, each of said end sections being generally hat-shaped in transverse cross section and including a horizontal top wall, a pair of opposed depending side walls, and two laterally outwardly extending horizontal flanges respectively integral with said side walls at the lower ends thereof; and two transition sections respectively coupled to the opposite ends of said central section, each of said transition sections including a transition member connected to the adjacent end section and to said lower portion of said central section, and two reinforcing members respectively overlying and underlying said transition member and connected thereto and to said central section and to the adjacent one of said end sections, said transition member cooperating with said underlying reinforcing member to define at one end of said transition member a rectangular transverse cross section for mating engagement with the adjacent one of said end sections and to define at the other end of said transition member a trapezoidal transverse cross section for mating engagement with said lower portion of said central section, each of said overlying reinforcing members having an inverted V-shaped transverse cross section and having one end thereof telescopically received within the adjacent end of said central section.

19. A railway hopper car comprising a car body defining a plurality of hoppers therein; draft and coupling mechanisms coupled to said car body at each end thereof; and a through center sill construction extending throughout the length of said car body, said center sill construction including an elongated central section extending substantially from one of said draft and coupling mechanisms to the other, and being substantially A-shaped in transverse cross section, said central section extending upwardly into said hoppers and being positioned to shed associated lading, and two end sections respectively coupled to said central section at the opposite ends thereof for respectively housing said draft and coupling mechanisms.

20. The railway hopper car of claim 19, wherein said central section comprises a plurality of subsections arranged in end-to-end relationship.

21. The hopper car of claim 19, wherein each of said end sections has a different transverse cross section from that of said central section, and further including two transition sections respectively connecting the ends of said central section to the adjacent end sections.

22. The railway hopper car of claim 19, wherein said central section is of two-part construction including an upper part having a transverse cross section substantially in the shape of an inverted V and a lower part having a transverse cross section generally in the shape of an open-bottom trapezoid, each of said upper and lower parts having a pair of upwardly converging inclined side walls, the side walls of said upper part being disposed in parallel overlapping relationship respectively with the side walls of said lower part.

23. The railway hopper car of claim 22, wherein each of said upper and lower parts comprises a plurality of subsections arranged in end-to-end relationship.

24. A railway hopper car comprising a car body defining a plurality of hoppers therein; draft and coupling mechanisms coupled to said car body at each end thereof; and a through center sill construction extending throughout the length of said car body, said center sill construction including an elongated central section extending substantially from one of said draft and coupling mechanisms to the other, said central section being substantially A-shaped in transverse cross section and including sloping side walls converging upwardly to an apex and a horizontal wall interconnecting said side walls intermediate the upper and lower ends thereof and separating said central section into upper and lower portions, said apex of said central section extending upwardly into said hoppers and being positioned to shed associated lading, two end sections respectively coupled to said draft and coupling mechanisms for housing same, and two transition sections respectively coupled to the opposite ends of said central section, each of said transition sections including a transition member connected to the adjacent end section and to said lower portion of said central section and two reinforcing members respectively overlying and underlying said transition member and connected thereto and to said central section and to the adjacent one of said end sections.

25. The railway hopper car of claim 24, wherein each of said overlying reinforcing members has an inverted V-shaped transverse cross section and overlies and is fixedly secured to said top wall of said transition member and to said top wall of the adjacent one of said end sections and to said horizontal wall of said central section, each of said overlying reinforcing members including a tubular reinforcing member extending transversely thereof.

26. The railway hopper car of claim 24, wherein each of said end sections is generally hat-shaped in transverse cross section including a horizontal top wall and a pair of opposed depending side walls and two laterally outwardly extending horizontal flanges respectively integral with said side walls at the lower ends thereof.

27. The railway hopper car of claim 26, wherein said transition member includes a top wall and a pair of opposed side walls, said transition member cooperating with said underlying reinforcing member to define at one end of said transition member a rectangular transverse cross section for mating engagement with the adjacent one of said end sections and to define at the other end of said transition member a trapezoidal transverse cross section for mating engagement with said lower portion of said central section.

28. The railway hopper car of claim 27, wherein each of said transition member side walls includes generally triangular upper and lower portions inclined at an obtuse angle with respect to each other and intersecting along a line extending from the top of the adjacent one of said end sections to said underlying reinforcing member at the associated one of said central section side walls.

29. The railway hopper car of claim 27, wherein said transition member includes a pair of flanges at the lower end thereof respectively disposed in end-to-end abutting relationship with said flanges of the adjacent one of said end sections and fixedly secured thereto.

30. A railway hopper car comprising a car body defining a plurality of hoppers therein; draft and coupling mechanisms coupled to said car body at each end thereof; and a through center sill construction extending throughout the length of said car body, said center sill construction including: an elongated central section extending substantially from one of said draft and coupling mechanisms to the other, said central section being substantially A-shaped in transverse cross section and including sloping side walls converging upwardly to an apex, and a horizontal wall interconnecting said side walls intermediate the upper and lower ends thereof and separating said central section into upper and lower portions, said apex of said central section extending upwardly into said hoppers and being positioned to shed associated lading; two end sections respectively coupled to said draft and coupling mechanisms for housing same, each of said end sections being generally hat-shaped in transverse cross section and including a horizontal top wall, a pair of opposed depending side walls, and two laterally outwardly extending horizontal flanges respectively integral with said side walls at the lower ends thereof; and two transition sections respectively coupled to the opposite ends of said central section, each of said transition sections including a transition member connected to the adjacent end section and to said lower portion of said central section, and two reinforcing members respectively overlying and underlying said transition member and connected thereto and to said central section and to the adjacent one of said end sections, said transition member cooperating with said underlying reinforcing member to define at one end of said transition member a rectangular transverse cross section for mating engagement with the adjacent one of said end sections and to define at the other end of said transition member a trapezoidal transverse cross section for mating engagement with said lower portion of said central section, each of said overlying reinforcing members having an inverted V-shaped transverse cross section and having one end thereof telescopically received within the adjacent end of said central section.

* * * * *